US005714052A

United States Patent [19]

Hoveling et al.

[11] Patent Number: 5,714,052

[45] Date of Patent: Feb. 3, 1998

[54] METHOD FOR PRODUCING BROCHANTITE PATINA ON COPPER

[75] Inventors: Stefan Hoveling; Dirk Rode; Helmut Protzer; Ruzica Luetic, all of Osnabrück, Germany

[73] Assignee: KM Europa Metal Aktiengesellschaft, Osnabrück, Germany

[21] Appl. No.: 772,200

[22] Filed: Dec. 20, 1996

[30] Foreign Application Priority Data

Dec. 22, 1995 [DE] Germany ..... 195 48 261.1

[51] Int. Cl.[6] ..... C25D 9/00; C25D 5/00; C25D 5/34

[52] U.S. Cl. ..... 205/137; 205/206; 205/215; 205/316

[58] Field of Search ..... 205/137, 206, 205/210, 316, 215

[56] References Cited

FOREIGN PATENT DOCUMENTS 2064465 7/1971 France .

*Primary Examiner*—Kathryn L. Gorgos
*Assistant Examiner*—Edna Wong
*Attorney, Agent, or Firm*—Kenyon & Kenyon

[57] ABSTRACT

A passthrough method is provided in which the surface of an industrial grade, low-grease precursor made of copper, with a defined surface roughness, is patinated. For this purpose the precursor material, connected as the anode, is passed through an electrolysis bath, containing sodium carbonate and/or sodium hydrogencarbonate as well as sodium sulfite and/or sodium disulfite, with a temperature of 30° C. to 90° C. and a current density of 1 A/dm$^2$ to 20 A/dm$^2$ as bath parameters, for a residence time of 10 seconds to 12 minutes. The precursor material is rinsed and then moved through a fixing bath at a temperature of 35° C. to 95° C. for a residence time of 10 seconds to 120 seconds, and lastly, after a further rinsing, is dried. The fixing bath contains at least one of the oxidation agents: hydrogen peroxide ($H_2O_2$), potassium chlorate ($KClO_3$), potassium peroxodisulfate ($K_2S_2O_8$), potassium permanganate ($KMnO_4$), of copper sulfate ($CuSO_4.5H_2O$).

16 Claims, No Drawings

METHOD FOR PRODUCING BROCHANTITE PATINA ON COPPER

FIELD OF THE INVENTION

The invention relates to a method for producing brochantite patina on a copper precursor surface.

BACKGROUND OF THE INVENTION

It is known that with normal atmospheric weathering, a tightly adhering thin top layer of brownish-red copper oxide initially forms on the surface of bare copper. Over time, the color of this top layer increasingly darkens toward anthracite brown. Especially when the copper surface is in an inclined position, such as on a sloping building surface, the anthracite brown top layer continues to change color, due to the formation of basic copper compounds as a result of the reaction with substances contained in the atmosphere such as sulfur dioxide, carbon dioxide, and chlorides. Ultimately, a patina green typical of copper, such as a basic copper sulfate (brochantite), can be reached as the final state. The formation of brochantite generally takes many years and depends on the geographical location of the weathering point and, in particular, on the inclination of the copper surfaces with respect to the particular weathering influences.

Because of this, the industry has previously attempted to accelerate the production of this final state, which is aesthetically attractive and protects the precursor material over the long term, by deliberate manipulation of the precursor material. In this regard, both chemical and electrolytic patination methods have been proposed. Among the proposed electrolytic methods is the method according to FR Patent 2 064 465 in which the copper precursor material is first subjected to a pretreatment by degreasing and pickling. The precursor material then passes through an anodic electrolysis consisting of a sodium hydrogencarbonate ($NaHCO_3$) electrolyte with added sulfates, nitrates, or phosphates, as well as chromates or dichromates. The method can be performed continuously or discontinuously at a bath temperature of approximately 20° C. to 30° C. A carbonate patina is formed, with some proportions of the materials added.

A substantial disadvantage of using anodic electrolysis is the fact that the ultimately desired brochantite still forms only in the course of weathering, and it is still possible for the patina to be impaired by chemical transformation, to the point of being partly or completely weathered off. Also, the resulting patina contains environmentally hazardous chromium compounds. Moreover the chromates used in electrolysis represent a considerable safety risk for those involved.

In view of the prior art, it is an object of the invention to provide a method for producing brochantite a patina on a surface consisting of copper, with which it is possible to produce, even on an industrial scale, a uniform, adherent, and weatherproof patina made of brochantite which is free of environmentally relevant constituents and largely nature-identical, and is not appreciably damaged, even during further processing of the precursor material that is used.

SUMMARY OF THE INVENTION

A passthrough method is provided to patinate an industrial grade, low-grease, copper precursor, wherein the surface of the precursor has a defined surface roughness. For this purpose the precursor material, connected as the anode, is passed through an electrolysis bath, containing sodium carbonate and/or sodium hydrogencarbonate as well as sodium sulfite and/or sodium disulfite, with a temperature of 30° C. to 90° C. and a current density of 1 A/dm$^2$ to 20 A/dm$^2$ as bath parameters, for a residence time of 10 seconds to 12 minutes. The precursor material is rinsed and then moved through a fixing bath at a temperature of 35° C. to 95° C. for a residence time of 10 seconds to 120 seconds, and lastly, after a further rinsing, dried. The fixing bath contains at least one of the oxidation agents, hydrogen peroxide ($H_2O_2$), potassium chlorate ($KClO_3$), potassium peroxodisulfate ($K_2S_2O_8$), potassium permanganate ($KMnO_4$), or copper sulfate ($CuSO_4.5H_2O$).

DETAILED DESCRIPTION OF THE INVENTION

The method of the present invention provides a uniform, continuous, passthrough process in which a precursor material can be used both in the form of panels and in the form of coils. The length of the precursor material on a coil is inherently unlimited. Preferably, however, coils with a weight between approximately 2 tonnes and 12 tonnes are used. The width of the precursor material (panels or coils) is also, in principle, unlimited. However, in terms of the practicability of the method, the width of a copper panel or a coil of copper sheet is between 300 mm and 1000 mm. A copper material with a strength of F20 to F37, in particular F24, according to DIN 17650 or DIN 17670 Part I is used as the precursor material.

The method is directed to patinating a surface of a copper precursor material. An essential component of the method according to the invention is the use of a suitable precursor material with an industrial-grade, low-grease surface and appropriate roughness. Roughening of the surface can be accomplished, for example, by sanding or brushing. A surface roughness $R_a$ of 0.1 μm to 20 μm, preferably 5 μm to 9 μm, is desirable. This roughness, in conjunction with the low-grease surface, is a prerequisite for good adhesion of the brochantite patina onto the precursor material, in particular for further processing thereof and also for its resistance to weathering.

In the subsequent process step, the precursor material to be patinated acts as the anode in an electrolyte containing sodium hydrogencarbonate ($NaHCO_3$) and sodium sulfite ($Na_2SO_3$) and/or sodium disulfite ($Na_2S_2O_5$). During this step, a green carbonate-sulfite patina having a thickness of 15 μm to 35 μm, which already adheres well to the precursor material, is produced on the precursor material. If sodium carbonate ($Na_2CO_3$) is used in this context, it is used at a concentration of 40 g/l to 90 g/l, preferably 60 g/l to 80 g/l. The sodium sulfite ($Na_2SO_3$) and sodium disulfite ($Na_2S_2O_5$) electrolyte constituents, however, are used at a concentration of 3 g/l to 20 g/l, preferably greater than 12 g/l.

The electrolysis bath is agitated and operated in this instance at a temperature of 30° C. to 90° C., preferably 35° C. to 50° C., the current density being 1 to 20 A/dm$^2$, preferably 3 to 10 A/dm$^2$. The residence time of the precursor material in the electrolysis bath is set at 10 sec to 12 min, preferably 2 to 6 min. If necessary, wetting agents in the form of nonfoaming or nonionogenic surfactants can also be added to the electrolyte, up to one percent.

The prepatinated blank is then rinsed and subsequently subjected to a post-oxidation treatment in a fixing bath in which the initially formed carbonate-sulfite patina is converted almost entirely into basic copper sulfate, i.e. into brochantite. The oxidation agent is preferably added to the fixing bath at a concentration of 10 g/l to 50 g/l. The reaction time for this is extremely short, preferably approximately 10 to 120 sec, specifically so that copper material can be advantageously patinated from the coil. The temperature of the fixing bath is between 35° C. and 95° C.

As a result of the method of the present invention, a brochantite patina is created in a very short time which largely corresponds to a natural brochantite patina in appearance and composition and, at the same time, has long-term resistance to weathering. The artificial patina has a color that ranges from yellow-green to turquoise. The coating contains approximately 3% to 13% sulfur, preferably 6% to 8%, and thus includes the typical concentration range of approximately 7.1% sulfur which is possessed by the natural brochantite patina. The final state of a naturally occurring brochantite is therefore present at the outset of an outside exposure, and provides long-term resistance to weathering. The coating is permanently adherent on the respective substrate, regardless of subsequent processing of the patinated precursor material. It is of course possible in this context for the precursor material being patinated to be prepared with a brochantite coating on one or both sides. The precursor material patinated in this fashion is not only suitable for interior handicrafts use, but is also particularly suitable for use in the industrial sector for covering surfaces of considerable extent. The method is efficient and simple. The chemicals used are environmentally benign and meet workplace regulations.

As an example of a preferred embodiment for patination, brochantite production proceeds as follows:

The starting material used is a coil of largely grease-free, F24, SFCu strip with a thickness of 0.7 mm, a width of 1000 mm, and a roughness of approximately 9 μm. The coil has a weight of 10 tonnes. The SFCu strip is uncoiled and passed horizontally through an electrolysis bath that is composed of an aqueous solution with 60 g/l of sodium carbonate ($Na_2CO_3$) and 15 g/l of sodium disulfite ($Na_2S_2O_5$). The temperature of the electrolysis bath is 45° C. At a current density of 10 A/dm$^2$, the residence time of the SFCu strip in the electrolysis bath is two minutes. The bath is kept in continuous motion by a corresponding pump.

After emerging from the electrolysis bath, the prepatinated strip is rinsed and then passed through a fixing bath having an aqueous solution of 50 g/l of potassium chlorate ($KClO_3$) to which up to 10 g/l of magnesium and/or zinc sulfate can be added. The temperature of the fixing bath is 40° C., and the residence time of the SFCu strip in the fixing bath is two minutes. Typical measured coating thicknesses are 15 μm to 20 μm.

After removal from the fixing bath, the SFCu strip passes through a further rinsing bath and is dried with a stream of air. Following drying, the SFCu strip is coiled up again and sent on for further processing.

What is claimed is:

1. A method for producing a broahantite patina on a surface of a copper precursor material, comprising the steps of:

roughening the surface of the copper precursor material which is to be patinated;

providing an electrolysis bath, the electrolysis bath being agitated and containing sodium carbonate ($Na_2CO_3$) or sodium hydrogencarbonate ($NaHCO_3$), and a salt of a sulfuric acid, or their derivatives, wherein the electrolysis bath has a temperature of 30° C. to 90° C. and a current density of 1 A/dm$^2$ to 20 A/dm$^2$;

passing the precursor material through the electrolysis bath, wherein the precursor material is connected as an anode and the precursor material is made to reside in the bath from 10 seconds to 12 minutes;

removing the precursor material from the electrolysis bath and rinsing the precursor material;

moving the precursor material through a fixing bath, the fixing bath containing at least one oxidation agent selected from the group consisting of: hydrogen peroxide ($H_2O_2$), potassium chlorate ($KClO_3$), potassium peroxodisulfate ($K_2S_2O_5$), potassium permanganate ($KMnO_4$) and copper sulfate ($CuSO_4.5H_2O$), wherein the fixing bath has a temperature of 36° C. to 95° C. and the precursor material is made to reside in the fixing bath from 10 seconds to 120 seconds;

removing the precursor material from the fixing bath and rinsing the precursor material; and drying the precursor material.

2. The method of claim 1, further comprising the step of degreasing the surface of the precursor material before the precursor material surface is roughened.

3. The method of claim 1, wherein the fixing bath includes magnesium sulfate or zinc sulfate or both.

4. The method of claim 1, wherein the temperature of the electrolysis bath is 35° C. to 50° C., the current density is 3 A/dm$^2$ to 10 A/dm$^2$, and the residence time is 2 to 6 minutes.

5. The method of claim 1, wherein the electrolysis bath includes sodium sulfite ($Na_2SO_3$) or sodium disulfite ($Na_2S_2O_5$) or both.

6. The method of claim 5, wherein the sodium sulfite ($Na_2SO_3$) and sodium disulfite ($Na_2S_2O_5$) have a concentration of 3 g/l to 2.0 g/l in the electrolysis bath.

7. The method of claim 5, wherein the sodium sulfite ($Na_2SO_3$) and sodium disulfite ($Na_2S_2O_5$) concentration in the electrolysis bath is greater than 12 g/l.

8. The method of claim 1, wherein the surface of the precursor material has a roughness ($R_a$) of 0.1 μm to 20 μm.

9. The method of claim 8, wherein the surface of the precursor material has a roughness ($R_a$) of 5 μm to 9 μm.

10. The method of claim 1, wherein the sodium carbonate ($Na_2CO_3$) and sodium hydrogencarbonate ($NaHCO_3$) have a concentration of 40 g/l to 90 g/l in the electrolysis bath.

11. The method of claim 10, wherein the concentration of the sodium carbonate ($Na_2CO_3$) and sodium hydrogencarbonate ($NaHCO_3$) in the electrolysis bath is 60 g/l to 80 g/l.

12. The method of claim 1, wherein up to 1% of a nonfoaming or nonionogenic surfactant is added to the electrolysis bath, the surfactant acting as a wetting agent.

13. The method of claim 1, wherein the oxidation agent has a concentration of 10 g/l to 50 g/l in the fixing bath.

14. The method of claim 1, wherein the precursor material is a copper material having a strength of F20 to F37 according to DIN 17650 or DIN 17670 Part I.

15. The method of claim 14, wherein the copper precursor material has a strength of F24 according to DIN 17650 or DIN 17670 Part I.

16. The method of claim 1, wherein the brochantite patina has a sulfur content of 3% to 13% and a coating thickness of 6 μm to 35 μm.

* * * * *

UNITED STATES PATENT AND TRADEMARK OFFICE

CERTIFICATE OF CORRECTION

PATENT NO. : 5,714,052

DATED : Feb. 3, 1998

INVENTOR(S) : HOVELING et al.

It is certified that error appears in the above-identified patent and that said Letters Patent is hereby corrected as shown below:

In column 3, line 56, change "broahantite" to --brochatite--;

In column 4, line 14, change "$K_2S_2O_5$" to --$K_2S_2O_8$,--.

In column 4, line 16, change "36°C." to --35°C.--.

In column 4, line 36, change "2.0g/1" to --20g/1--.

Signed and Sealed this

Tenth Day of November 1998

Bruce Lehman

*Attest:*

BRUCE LEHMAN

*Attesting Officer*

*Commissioner of Patents and Trademarks*